US006745435B2

(12) United States Patent
Bowers

(10) Patent No.: US 6,745,435 B2
(45) Date of Patent: Jun. 8, 2004

(54) REMOVABLE, REUSABLE HINGE-MASKING DEVICE

(76) Inventor: Tracy D. Bowers, 18075 Bear Valley Rd., Unit A, Hesperia, CA (US) 92345

( * ) Notice: Subject to any disclaimer, the term of this patent is extended or adjusted under 35 U.S.C. 154(b) by 0 days.

(21) Appl. No.: 10/329,034

(22) Filed: Dec. 24, 2002

(65) Prior Publication Data

US 2003/0213097 A1 Nov. 20, 2003

Related U.S. Application Data

(60) Provisional application No. 60/381,669, filed on May 17, 2002.

(51) Int. Cl.[7] ..... E05D 11/00
(52) U.S. Cl. ..... 16/250
(58) Field of Search ..... 16/250, 251; 118/213, 118/301, 504, 505

(56) References Cited

U.S. PATENT DOCUMENTS

| | | | | | |
|---|---|---|---|---|---|
| 3,961,602 | A | * | 6/1976 | Dresser | 118/505 |
| 4,691,409 | A | * | 9/1987 | Torgerson et al. | 16/250 |
| 4,796,330 | A | * | 1/1989 | Ziegler | 16/251 |
| 4,921,028 | A | * | 5/1990 | Schwartz | 150/155 |
| 5,056,191 | A | | 10/1991 | Love | |
| 5,198,031 | A | | 3/1993 | Derstine | |
| 5,224,240 | A | * | 7/1993 | Smith et al. | 16/251 |
| D361,021 | S | * | 8/1995 | Harper | D8/14 |
| 5,722,120 | A | * | 3/1998 | Bindschatel et al. | 16/250 |
| 6,165,269 | A | | 12/2000 | Kathe | |
| 2001/0036540 | A1 | * | 11/2001 | Pringle et al. | 428/202 |
| 2002/0004103 | A1 | | 1/2002 | Lynch | |
| 2002/0178543 | A1 | | 12/2002 | Emerson et al. | 16/250 |

FOREIGN PATENT DOCUMENTS

| | | |
|---|---|---|
| WO | WO 9216367 | 10/1992 |

* cited by examiner

*Primary Examiner*—Chuck Y. Mah
(74) *Attorney, Agent, or Firm*—Michael L. Diaz

(57) ABSTRACT

A removable, reusable one-piece device for masking a door hinge to prevent paint from getting on the hinge while the door and/or door frame are being painted. The device includes an interior section having two sheets which are sized and shaped to cover the hinge plates of the door hinge. The two sheets are connected by a flexible sheet which covers an interior portion of a barrel of the hinge. On an exterior section of the device is a covering strip for covering an exterior portion of the barrel. The covering strip may include magnetic adhesive strips allowing attachment of the exterior section to the exterior portion of the barrel. The exterior section is connected to the interior section of the device, thus allowing a top portion of the hinge to be covered.

10 Claims, 3 Drawing Sheets

REMOVABLE, REUSABLE HINGE-MASKING DEVICE

RELATED APPLICATIONS

This utility application claims the priority date of Provisional Patent Application Serial No. 60/381,669 filed May 17, 2002 and is hereby incorporated by reference.

BACKGROUND OF THE INVENTION

1. Technical Field of the Invention

This invention relates to painting equipment. More particularly, and not by way of limitation, the present invention is directed to a removable, reusable one-piece device for masking a door hinge to prevent paint from getting on the hinge while the door and/or door frame are being painted.

2. Description of Related Art

Many doors and door frames are painted. While they are being painted, it is important, both for appearance and function, to keep paint from getting on the door hinges. In the past, painters have painstakingly masked the hinges with masking tape that must be cut with a knife to conform to the edges of the mounting plates of each hinge. If the door is then opened or closed, the tape is torn or pulled into the slits between each portion of the barrel of the hinge, where it is extremely difficult to remove. If the tape is not properly removed, it creates a poor appearance and may cause the hinge to function improperly. In some cases, the door must be taken off the hinges to properly clean out the tape.

Although there are no known prior art teachings of an apparatus or system such as that disclosed herein, a prior art reference that discusses subject matterthat bears some relation to matters discussed herein is U.S. Patent Application Publication Number 2002/0178543 to Emerson et al. (Emerson). Emerson discloses a door hinge mask. The mask includes two parts which cover the door hinge. However, Emerson suffers from the disadvantage of utilizing two pieces which increases the difficulty in affixing the mask to the door hinge and increases the likelihood of losing one of the parts of the mask.

In order to overcome the disadvantage of existing solutions, it would be advantageous to have a removable, reusable device for masking a door hinge to prevent paint from getting on the hinge while the door and/or door frame are being painted. The present invention provides such a device.

SUMMARY OF THE INVENTION

In one aspect, the present invention is a removable device for masking a door hinge to prevent paint from covering the hinge during painting operations. The hinge includes an interior section having first and second sheets. The first sheet and the second sheet are each sized and shaped to fit upon a first hinge plate and a second hinge plate of an interior portion of the door hinge. The first sheet and the second sheet each are removably attached to each corresponding hinge plate of the door hinge. The first sheet is attached to the second sheet by a flexible strip sized and shaped to cover the interior portion of a barrel of the door hinge. The device also includes an exterior section having covering strip sized and shaped to cover an exterior portion of the barrel. The exterior section is attached to the interior section. The exterior section is removably attached to the exterior portion of the hinge. The interior section covers the interior portion of the hinge and the exterior section covers the exterior portion of the door hinge to prevent paint from adhering to the door hinge during painting operations.

In another aspect, the present invention is a removable device for masking a door hinge to prevent paint from covering the hinge during painting operations. The device includes an interior section having a first magnetic sheet and a second magnetic sheet. Each sheet is sized and shaped to fit upon a first hinge plate and a second hinge plate of an interior portion of the door hinge. The first sheet is attached to the second sheet by a flexible strip sized and shaped to cover the interior portion of a barrel of the door hinge. The device also includes an exterior section which has a covering strip sized and shaped to cover an exterior portion of the barrel. The exterior section has a first magnetic strip on a first side of the covering strip and a second magnetic strip on an opposite second side of the covering strip. The first magnetic strip is attached to a first side of the exterior portion of the barrel and the second magnetic strip is attached to a second opposite side of the exterior portion of the barrel. The exterior section is connected to the interior section. The interior section covers the interior portion of the hinge and the exterior section covers the exterior portion of the door hinge to prevent paint from adhering to the door hinge during painting operations.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF EMBODIMENTS

Figure 1:
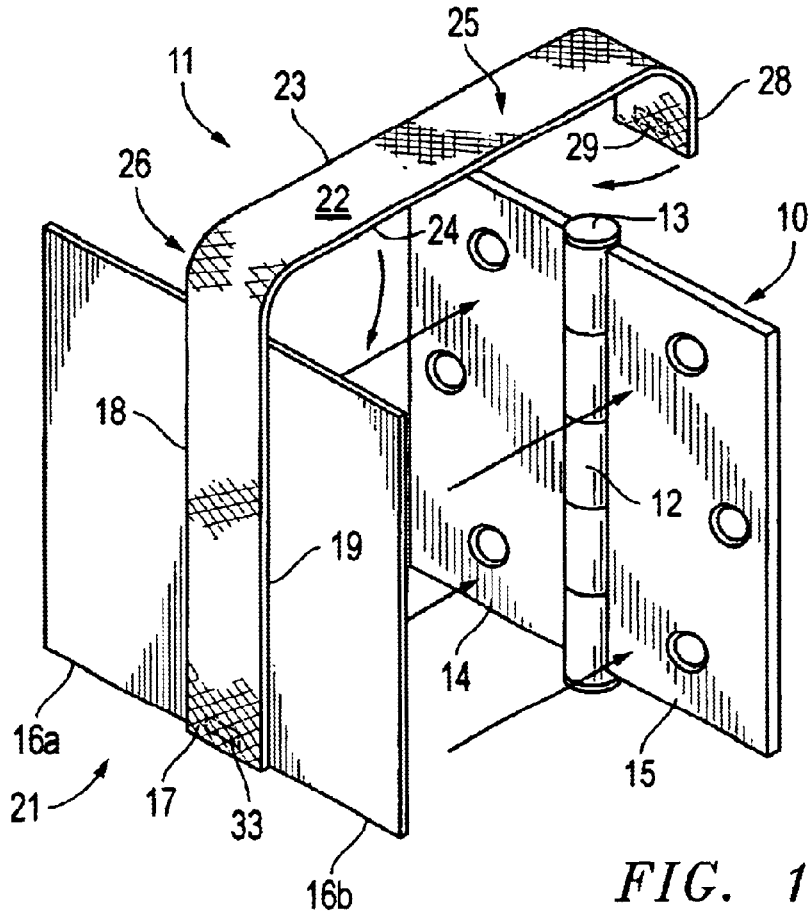
FIG. 1 is a perspective view of a door hinge illustrating the placement of a one-piece device of the present invention on the hinge.

FIG. 1 is a perspective view of a door hinge 10 illustrating the placement of a preferred embodiment of a one-piece device 11 of the present invention on the hinge. The hinge includes a barrel 12 with a shaft pin 13 extending vertically therethrough. As is known in the art, metal hinge plates 14 and 15 are utilized to mount the hinge to a door and door frame (not shown).

A front portion 21 of the device is applied to the interior side of the hinge 10 (i.e., the side on which the hinge plates 14 and 15 come together when the door is closed). A rear portion 25 of the device is applied to the exterior side of the hinge. In a preferred embodiment, the interior front portion 21 comprises two thin magnetic sheets 16*a* and 16*b* which may be sized to fit various standard sizes of hinge plates. The magnetic sheets are preferably approximately 1/32-inch thick. If the sheets are too thick, the door may not close properly with the device mounted on the hinge. If the sheets are too thin, they may be flimsy and difficult to handle and position properly on the hinge plates.

The magnetic sheets 16*a* and 16*b* are connected by a flexible strip 17. The strip may be thin plastic or cloth, or any other material that is flexible and impervious to paint. The strip must be able to fold when the door is closed upon it. The strip is also cut wide enough so that there is some slack in it. In this way, if the hinge is opened further after the device is mounted, the strip will not tear. In the preferred embodiment, the magnetic sheets have a removable paper backing that covers an adhesive applied to the magnetic sheets. Magnetic sheets of this type are commonly sold in home supply stores in large rolls. The sheets can then be cut to size. Optionally, by removing thin slices 18 and 19 of the paper backing from the side of each magnetic sheet adjacent to the hinge barrel 12, a slice of adhesive is exposed. The strip 17 may then attached to the magnetic sheets by pressing opposite edges of the strip onto the exposed adhesive slices on the side of each magnetic strip.

The front portion 21 is then mounted on the hinge 10 by placing the magnetic sheets 16*a* and 16*b* against the metal hinge plates 14 and 15, respectively. The door and door frame on the interior side of the hinge can then be painted without getting any paint on the hinge. The door can also be opened and closed normally. When the painting is complete, the device may be easily removed by simply grasping the strip 17 and pulling the magnetic sheets 16*a* and 16*b* away from the metal hinge plates 14 and 15.

Rear portion 25 of the device is applied to the exterior side of the hinge 10. On the exterior side, generally only the barrel 12 of the hinge (and possibly a small portion of the hinge plates 14 and 15) is exposed. In the preferred embodiment, rear portion 25 comprises a length of covering strip 22. The covering strip may optionally include two narrow strips 23 and 24 having attaching means along each side of the tape. Preferably, the attaching means are magnetic strips. In an alternate embodiment of the present invention, the strips may include adhesive. The central part of the covering strip does not have any adhesive or magnetic properties. Rear portion 25 may then mounted over the hinge barrel using the narrow edge strips 23 and 24. Thus, when mounted on the exterior side of the hinge, the central part of the covering strip does not adhere to the barrel. In addition, the covering strip is cut wide enough to provide a significant amount of slack so that the tape does not tear when the door is closed. In addition, the covering strip 22 is attached to the flexible strip 17 by a connecting section 26 providing a flexible connection. On an opposite end from the connection section 26 is a wrap-around extension 28. The wrap-around extension may be folded underneath a bottom portion of the barrel 12. The wrap-around extension may then be connected to the flexible strip by the use of strips 29 and 33. The strips may be affixed by any attaching means, such as adhesive, snaps, or hook and pile strips. By wrapping the wrap-around extension around the underside of the barrel 12, the entire door hinge is protected.

Figure 2:
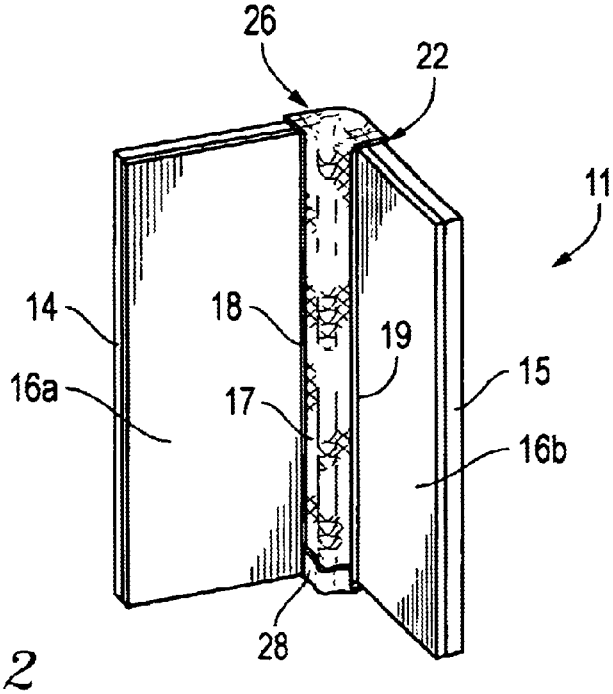
FIG. 2 is a perspective view of the door hinge of FIG. 1 illustrating the unimpeded operation of the hinge with the device mounted thereon.

FIG. 2 is a perspective view of the door hinge 10 of FIG. 1 illustrating the unimpeded operation of the hinge with the device mounted thereon. As can be seen, the slack in the covering strip 22 enables the hinge to close without tearing the covering strip. The flexibility of the flexible strip 17 enables the hinge to close by folding the flexible strip.

Figure 3:
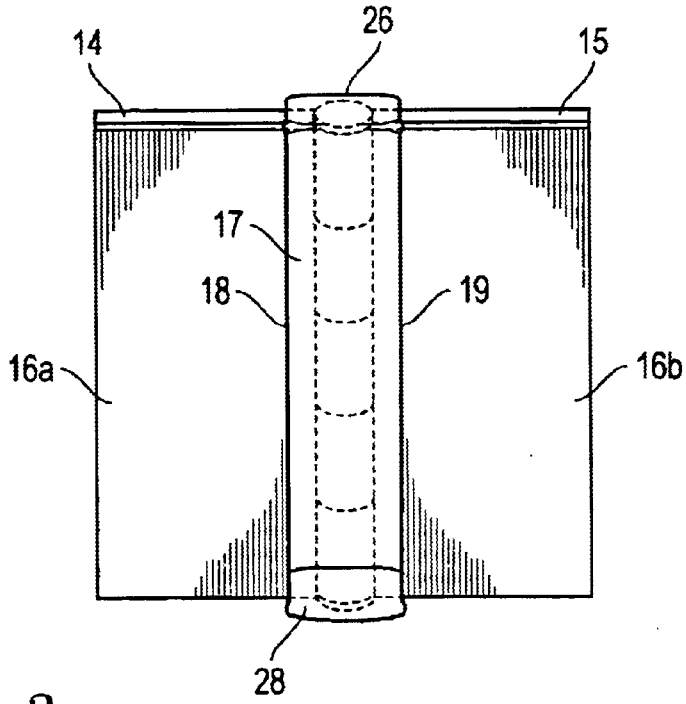
FIG. 3 is a front elevation view of the door hinge of FIG. 1 with the device mounted thereon.

FIG. 3 is a front elevation view of the door hinge 10 of FIG. 1 with the device mounted thereon.

Figure 4:
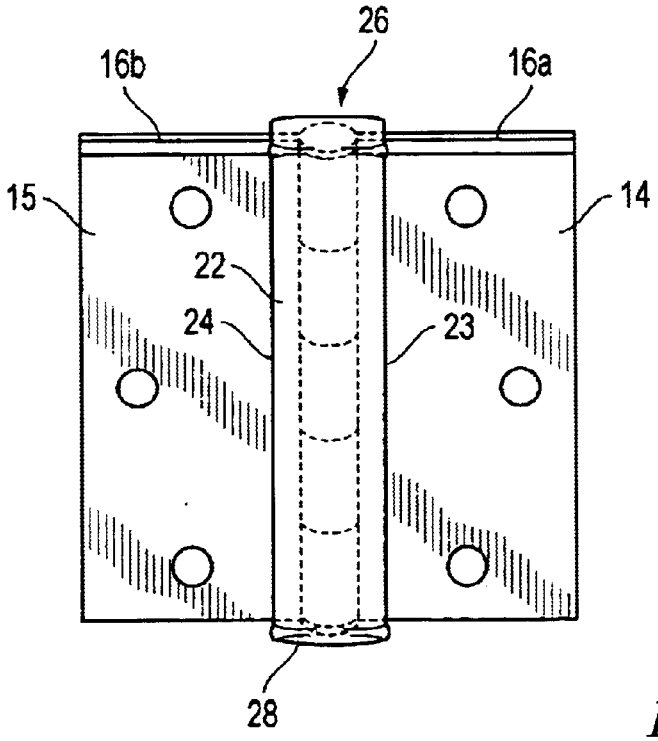
FIG. 4 is a rear elevation view of the door hinge of FIG. 1 with the device mounted thereon.

FIG. 4 is a rear elevation view of the door hinge 10 of FIG. 1 with the device mounted thereon.

Figure 5:
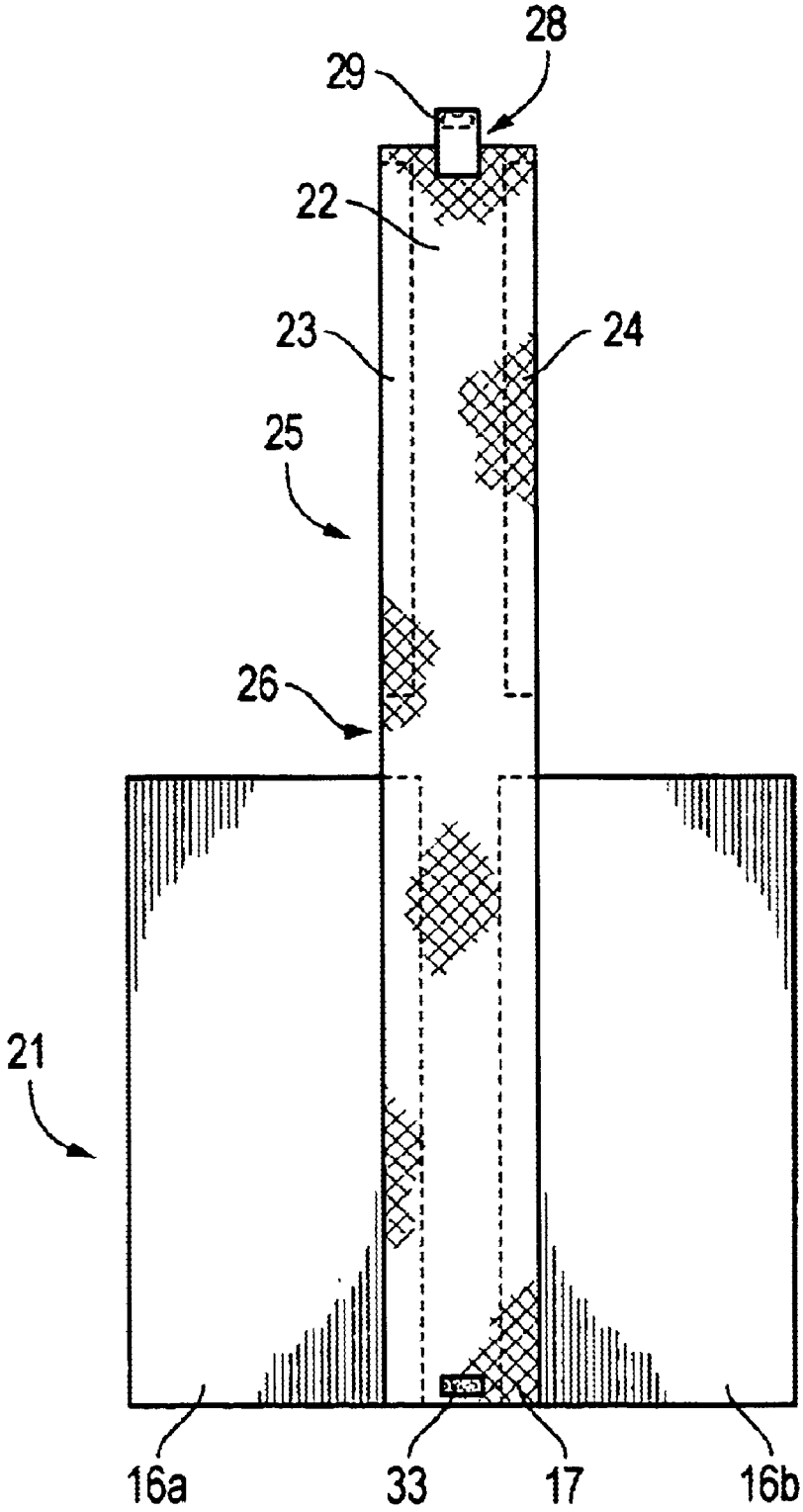
FIG. 5 is a front elevation view of the device in an extended/open configuration removed from the door hinge in the preferred embodiment of the present invention.

FIG. 5 is a front elevation view of the device in an extended/open configuration removed from the door hinge in the preferred embodiment of the present invention. The one-piece device 11 includes the front portion 21 connected to the rear portion 25. The front portion includes the two magnetic sheets 16*a* and 16*b*. The front portion extends into the connection section 26 and the rear portion 25.

As illustrated in FIG. 5, the device 11 is shown in the extended position, prior to placement of the device upon the hinge. When utilizing the device upon the hinge, the magnetic sheets are positioned against the metal hinge plates 14 and 15. Rear portion 25 of the device is rotated over a top portion of the hinge 10 and barrel 12. In a similar manner as discussed in FIGS. 1 and 2, the covering strip 22 is mounted over the exterior side of the hinge. The covering strip is affixed to the outer perimeter of the hinge by the magnetic strips. The central part of the covering strip does not have any adhesive or magnetic material. Thus, when mounted on the exterior side of the hinge, the central part of the covering strip does not adhere to the barrel. In addition, the covering strip is cut wide enough to provide a significant amount of slack so that the tape does not tear when the door is closed.

As discussed above, the front and rear portions 21 and 25 are connected. The connection section 26 covers a top portion of the barrel. The wrap-around extension 28 covers the bottom portion of the barrel. In another alternate embodiment of the present invention, the device 11 does not include the wrap-around extension 28.

Additionally, it should be noted that the flexible strip 17 and the covering strip 22 may be cut slightly longer than the length of the hinge pin 13 and barrel 12. In this way, the top and bottom of the hinge pin and barrel are protected from paint that is sprayed from a sprayer onto the door and door frame. The covering strip and the flexible strip may be made of any material which masks the door hinge, such as plastic or vinyl.

The device is not limited to the use of magnetic sheets for mounting the device to the hinge plates. In an alternative embodiment, the device may utilize thick paper, cardboard, plastic sheets, or the like. The sheets may be mounted on the hinge plates with a weak adhesive. The sheets can then be removed in much the same way as Post-it® notes from 3M Company are removed from a sheet of paper. In still another embodiment, thin plastic sheets may be utilized that build up a static electricity charge on their surface. The sheets can then be placed onto the metal hinge plates where the static electricity charge keeps them in place until the flexible strip 17 or the covering strip 22 are pulled by the painter.

It is thus believed that the operation and construction of the present invention will be apparent from the foregoing description. While the hinge-masking device shown and described has been characterized as being preferred, it will be readily apparent that various changes and modifications could be made therein without departing from the scope of the invention.

What is claimed is:

1. A removable device for masking a door hinge to prevent paint from covering the hinge during a painting operations, said device comprising:

an interior section having a first sheet and a second sheet, the first sheet and the second sheet each being sized and shaped to fit upon a first hinge plate and a second hinge plate of an interior portion of the door hinge, the first sheet and the second sheet each having removable attachment means for attachment to each corresponding hinge plate of the door hinge;

the first sheet attached to the second sheet by a flexible strip sized and shaped to cover the interior portion of a barrel of the door hinge; and an exterior section having covering strip sized and shaped to cover an exterior portion of the barrel and connected to said interior section, said exterior section having removable means for attaching to the exterior portion of the hinge;

whereby said interior section covers the interior portion of the hinge and said exterior section covers the exterior portion of the door hinge to prevent paint from adhering to the door hinge during painting operations.

2. The removable device for masking a door hinge of claim 1 wherein attachment means for attaching the first sheet to the first hinge plate and the second sheet to the second hinge plate includes a magnetic sheet on the first sheet and a magnetic sheet on the second sheet for attachment to the first and second hinge plates.

3. The removable device for masking a door hinge of claim 1 covering strip includes a first adhesive strip on a first perimeter side of the covering strip and a second adhesive strip on an opposite second perimeter side of the covering strip for attaching the exterior section to the exterior portion of the door hinge, whereby the first adhesive strip attaches to a first side of the exterior portion of the barrel and the second adhesive strip attaches to a second opposite side of the exterior portion of the barrel.

4. The removable device for masking a door hinge of claim 1 covering strip includes a first magnetic strip on a first side of the covering strip and a second magnetic strip on an opposite second side of the covering strip for attaching the exterior section to the exterior portion of the door hinge, whereby the first magnetic strip attaches to a first side of the exterior portion of the barrel and the second magnetic strip attaches to a second opposite side of the exterior portion of the barrel.

5. The removable device for masking a door hinge of claim 1 wherein the flexible strip is longer than the length of the interior portion of the barrel.

6. The removable device for masking a door hinge of claim 1 wherein the covering strip is longer than the length of the interior portion of the barrel.

7. The removable device for masking a door hinge of claim 1 wherein attachment means for attaching the first sheet to the first hinge plate and the second sheet to the second hinge plate includes a plastic sheet on the first sheet and a plastic sheet on the second sheet for attachment to the first and second hinge plates, each plastic sheet producing a static electricity charge allowing adherence of each sheet to each corresponding hinge plate.

8. A removable device for masking a door hinge to prevent paint from covering the hinge during a painting operations, said device comprising:

an interior section having a first magnetic sheet and a second magnetic sheet, the first sheet and the second sheet each being sized and shaped to fit upon a first hinge plate and a second hinge plate of an interior portion of the door hinge;

the first sheet attached to the second sheet by a flexible strip sized and shaped to cover the interior portion of a barrel of the door hinge; and an exterior section having a covering strip sized and shaped to cover an exterior portion of the barrel;

said exterior section having a first magnetic strip on a first side of the covering strip and a second magnetic strip on an opposite second side of the covering strip, the first magnetic strip attaching to a first side of the exterior portion of the barrel and the second magnetic strip attaching to a second opposite side of the exterior portion of the barrel;

said exterior section being connected to said interior section by a connecting strip;

whereby said interior section covers the interior portion of the hinge and the exterior section covers the exterior portion of the door hinge to prevent paint from adhering to the door hinge during painting operations.

9. The removable device for masking a door hinge of claim 8 further comprising a wrap-around extension located on an opposite end of the exterior section, said wrap-around extension being wrapped around a bottom portion of the door hinge.

10. The removable device for masking a door hinge of claim 9 wherein said wrap-around extension is removably attached to a bottom portion of the interior section.

* * * * *